US006481406B2

(12) United States Patent
Pels

(10) Patent No.: US 6,481,406 B2
(45) Date of Patent: Nov. 19, 2002

(54) STARTER SYSTEM AND METHODS FOR STARTING AN INTERNAL COMBUSTION ENGINE

(75) Inventor: Thomas Pels, Achern (DE)

(73) Assignee: Continential ISAD Electronic Systems GmbH & Co., oHG, Lansberg (DE)

( * ) Notice: Subject to any disclaimer, the term of this patent is extended or adjusted under 35 U.S.C. 154(b) by 0 days.

(21) Appl. No.: 09/800,243

(22) Filed: Mar. 6, 2001

(65) Prior Publication Data

US 2002/0020381 A1 Feb. 21, 2002

Related U.S. Application Data

(63) Continuation of application No. PCT/EP99/06577, filed on Sep. 7, 1999.

(30) Foreign Application Priority Data

Sep. 7, 1998 (DE) ..... 198 40 819

(51) Int. Cl.[7] ..... F02N 11/08

(52) U.S. Cl. ..... 123/179.3; 290/31; 290/50; 320/136

(58) Field of Search ..... 123/179.3; 320/134, 320/136; 290/22, 31, 50; 307/10.6, 10.7

(56) References Cited

U.S. PATENT DOCUMENTS

| | | | | |
|---|---|---|---|---|
| 5,041,776 A | | 8/1991 | Shirata et al. | 322/29 |
| 5,207,194 A | | 5/1993 | Clerici | 123/179.1 |
| 5,325,042 A | | 6/1994 | Murugan | 322/10 |
| 5,598,088 A | * | 1/1997 | Richter | 320/134 |
| 6,177,734 B1 | | 1/2001 | Masberg et al. | 290/31 |

FOREIGN PATENT DOCUMENTS

| | | | |
|---|---|---|---|
| DE | 3423767 C2 | | 3/1991 |
| DE | 4135025 A1 | | 4/1992 |
| DE | 4341826 A1 | | 6/1994 |
| EP | 0 390 398 A1 | | 3/1990 |
| EP | 0 391 065 A2 | | 10/1990 |
| EP | 0 403 051 A1 | | 12/1990 |
| EP | 042 990 34 | | 10/1992 |
| EP | 0 533 037 B1 | | 3/1993 |
| EP | 0 621 990 B1 | | 11/1994 |
| JP | 02175350 A | | 7/1990 |
| JP | 02175351 A | | 7/1990 |
| JP | 041 852 41 | | 7/1992 |
| SU | 1265388 | | 10/1986 |
| WO | WO 97/08456 | | 3/1997 |

OTHER PUBLICATIONS

IBM Technical Disclosure Bulletin, vol. 37 No. 06A, Jun. 1994.

PCT International Search Report, dated Jan. 12, 2000, PCT Appl. No. PCT/EP99/06577.

*International Preliminary Examination Report* corresponding to International Patent Application Serial No. PCT/EP99/06577, dated Apr. 5, 2001, 5 pages.

* cited by examiner

*Primary Examiner*—Andrew M. Dolinar
(74) *Attorney, Agent, or Firm*—Marshall, Gerstein & Borun

(57) ABSTRACT

The invention is directed to a starter system for an internal combustion engine, comprising an electric starter; a starter battery for warming up or starting the combustion engine; a temperature measuring device for measuring the temperature of the starter battery; a power electronics module, which actively varies the magnitude of a discharge current drawn from the starter battery for the purpose of warming up or starting the engine; and a control device, feeding the power electronics module with the value of the discharge current to be varied, where, at low battery temperatures, the maximum discharge current is lower than at high temperatures. The invention is also directed to a method for starting an internal combustion engine.

21 Claims, 4 Drawing Sheets

STARTER SYSTEM AND METHODS FOR STARTING AN INTERNAL COMBUSTION ENGINE

RELATED APPLICATIONS

This application is a continuation of and claims priority under 35 U.S.C. §120 from PCT application Ser. No. PCT/EP99/06577, filed Sep. 7, 1999.

FIELD OF THE INVENTION

The present invention relates generally to starters, and more particularly to a starter system and a method for starting an internal combustion engine.

BACKGROUND OF THE INVENTION

Conventional starters are normally designed as series-wound DC motors. Therefore, it is usual to choose a series-wound motor, as this type of motor supplies a relatively high starting torque to make the internal combustion engine "turn over". However, this means that considerable currents flow at the high torques to be applied.

During a cold start, the internal combustion engine generates considerable torque in opposition to the starter motor, via the very high shearing forces in the engine oil, so that the starting current at low temperatures rises steeply and may be, for example, some hundreds of amperes in starter motors capable of driving large internal combustion engines. At the same time, the internal resistance of the starter battery rises as the temperature falls, severely limiting the available power or the discharge current that may be drawn. As a result of both these factors—their effect increasing as the temperature falls—it is not unusual for the starter battery to fail during a cold start, because the discharge current "demanded" by the starter motor is too high.

Current technology offers a number of known proposals designed to make starting certain at low temperatures. Many of these proposals work by providing an additional short-term energy boost in the form of a storage capacitor, which is charged up slowly before the starting process. In some of these proposals, the battery and the pre-charged capacitor are connected in parallel for starting, so that both energy sources contribute to the start-up process (JP 02175350A (Isuzu) and JP 02175351A (Isuzu)). In other proposals, the storage capacitor for the starting process is separate from the starter battery, starting thus being achieved entirely via the energy stored in it (DE 41 35 025 A1 (Magneti Marelli) and U.S. Pat. No. 5,051,776 (Isuzu)). In other proposals of this nature, the starting energy required is provided via the potential difference across the starter battery (12V or 24V) by means of a DC-DC converter (a so-called up-converter), which first raises the voltage and then stores it in a capacitor (SU 1265388 A1 (Mosc Automech) and EP 0 390 398 A1 (Isuzu)). The higher voltage during starting, combined with a lower discharge current, thus allows the latter proposals to provide guaranteed starting even at low temperatures.

EP 0 403 051 A1 (Isuzu) also gives details of a process for charging a storage capacitor up to a certain variable voltage level only, dependent on the temperature of the engine coolant at the time, for the purpose of providing starting energy.

There is also a range of proposals for sensing the temperatures in the vehicle and influencing the control of electrical processes:

Thus, for example, EP 0 553 037 B1 (Magneti Marelli) gives details of a storage capacitor for feeding an electrical catalytic heating system, in which the capacitor discharge, and thus the degree of heating, is controlled as a function of the temperature.

There has been a further proposal to measure the vehicle battery temperature and vary the charging current, employing a change in generator excitation, as a function of the temperature; and of course the charging current at lower temperatures may thus be raised. This can obviously be employed, even at low temperatures, if the battery is "resistant to charging", to avoid increasing the charging time (DE 34 23 767 A1 (Bosch) and EP 0 621 990 B1 (Bosch)).

To avoid adversely affecting the function of other electrical consumers such as the ignition and fuel injection systems—despite the steep fall in supply voltage during a cold start, the use of up-converters to maintain the supply voltage constant has also been recommended (EP 0 391 065 A2 (Bosch)).

Finally, WO 97/08456 (Clouth et al.) provides details of a modern high performance starter based on an alternator, where the starter battery DC voltage is converted and, in connection with this conversion, stepped up to a higher voltage level via an intermediate DC circuit. Special measures to guarantee a sure start at low temperatures are not specifically mentioned in this.

U.S. Pat. No. 5,325,042 gives details of a starter system for a combustion engine in the form of a turbine, with an electric starter, a starter battery, a power electronics module in the form of a voltage source converter, which actively varies the value of the discharge current drawn by the starter battery for the purpose of starting, and a control device based on pulse width modulation, feeding the power electronics module with the charging current to be varied.

DE 43 41 826 A1 gives details of an internal combustion engine with automatic shutdown, employing a sensor to detect the temperature of a starter battery and feed a control device. Depending on the measured temperature value, a decision is made on whether to shut the engine down when stopped at traffic lights or not.

IBM Technical Disclosure Bulletin Volume 37, No. 6A, June 1994, S. 609–610 mentions a battery charging and discharging circuit for portable equipment, in which the battery temperature is sampled and, depending on the result, the on-off ratio of the discharge current under load, and thus its mean value, may be varied. At low battery temperatures, this value is greater than at high temperatures.

Some of the proposals mentioned during this introduction, e.g. that from Mosc Automech, can avoid the battery failing when starting under cold conditions is wanted.

SUMMARY OF THE INVENTION

The invention provides a starter system for an internal combustion engine. It comprises an electric starter, a starter battery for warming up or starting the combustion engine, a temperature measuring device for measuring the temperature of the starter battery, a power electronics module, which actively varies the magnitude of a discharge current drawn from the starter battery for the purpose of warming up or starting the engine, and a control device. The control device feeds the power electronics module with the value of the discharge current to be varied, where, at low battery temperatures, the maximum discharge current is lower than at high temperatures.

According to another aspect, the invention provides a method for starting an internal combustion engine with an electric starter, a starter battery and a device for measuring the temperature of the starter battery. The method comprises measuring the starter battery temperature, determining the maximum discharge current as a function of the measured battery temperature, and actively limiting the discharge current drawn by the electric starter for the purpose of starting or warming-up to the calculated maximum value.

Other features are inherent in the disclosed system, computer program product and method or will become apparent to those skilled in the art from the following detailed description of embodiments and its accompanying drawings.

DESCRIPTION OF THE PREFERRED EMBODIMENTS

Throughout the figures, functionally identical or similar components are marked identically in the figures.

Figure 1:
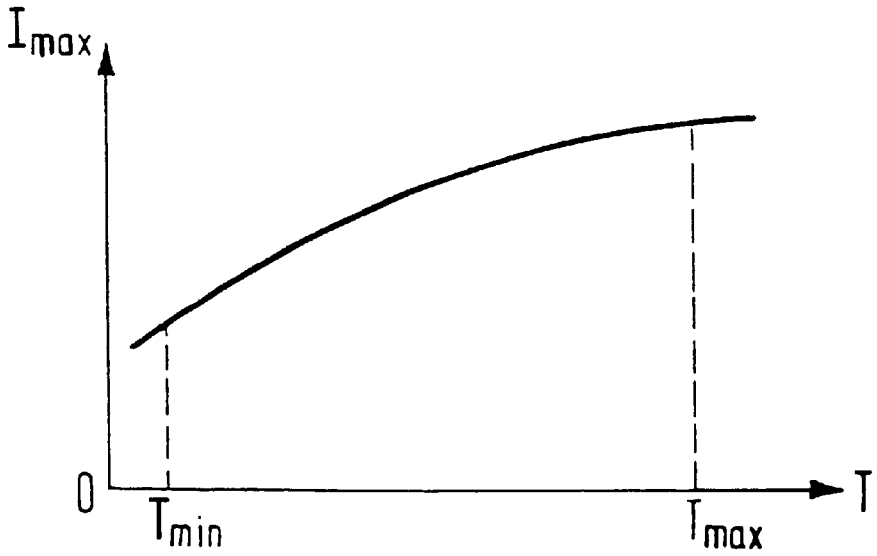
FIG. 1 shows a graph of the maximum discharge current as a function of battery temperature.

FIG. 1 shows a graph of the maximum discharge current as a function of battery temperature. Before proceeding further with the description, however, a few items of the preferred embodiments will be discussed.

In the preferred embodiments, the battery temperature—and thus, indirectly, its internal resistance—is detected before the start and, with the aid of this value, a reliable, temperature-dependent load current is determined. In the great majority of cases, this precaution avoids battery failure at low temperatures and e increases the certainty of a cold start. In those cases where no additional short-term energy source or something similar is provided, the starter naturally provides only a limited amount of electrical energy. In many instances where battery failure occurred hitherto, this limited power is still sufficient for starting. In those cases where the engine can no longer turn over in the starting process due to power limitation, this will at the least avoid discharging the battery while attempting to start, so that, after warming the battery, it is still possible to start the engine.

It should be noted that the term "starter battery" does not mean that this has to be used exclusively for starting. It may feed many other consumers in addition to the starter, as is normal practice in automobiles.

In the preferred embodiments, the starter is fed with a higher voltage than the starter battery provides (normally 12V or 24V). Operation at such a higher voltage (e.g. 48V) allows more favorable design of the starter machine. A up-converter is connected between the two voltage levels, also assuming the task of actively varying the discharge current.

Preferably, the starter is designed as an alternator whose supply voltage is taken by inverting the DC provided via an intermediate circuit. Then, it is advantageous that the above-mentioned voltage is the intermediate circuit voltage. The up-converter mentioned is then connected between the starter battery and the intermediate circuit. In an alternator starter, a raised intermediate voltage has the advantage that the unavoidable losses in the semi-conductor elements of the converter are lower.

In one preferred embodiment, the starter battery draws the energy for the starting process via the up-converter. In an alternative, at least one short-term energy source is provided adjoining the starter battery, providing all or part of the starting energy to the starter. The short-term energy source is charged up during a warm-up phase by means of a discharge from the starter battery. The power electronics module is connected between the starter battery and the short-term energy source and actively varies the magnitude of the discharge current drawn from the starter battery for the purpose of charging the short-term energy source. A combination of both alternatives is also possible, in which the short-term energy source is used only in a supporting capacity. To do this, the starter battery first charges up the short-term energy source during a warm-up phase. During the starting process, both then provide energy to the starter. Incidentally, by short-term energy source is meant a source that, in relation to the amount of energy it can store, is able to deliver high power, or, in other words, is capable of rapid discharge (in the order of 0.1 to 5 minutes, for example). For this purpose are numbered, for example, high performance capacitors, rapid voltaic cells, and combinations of these (e.g. the so-called Ultra-Caps). The use of a short-term energy source has yet another advantage: on those occasions where the electrical energy that can be transferred directly from the starter battery to the starter is no longer sufficient for the starting process, there is, in most cases, still enough residual energy in the battery to charge up the short-term energy source adequately. The power electronics module provides the means to effect the charging process, dependent on the battery temperature, so that the charging time is minimized. After charging with the required energy, the short-term source then surrenders this to provide the starting power required.

The short-term energy source can be charged to a higher voltage than that of the starter battery. This higher voltage is preferably raised to the increased intermediate circuit voltage, or a value fairly close to it. In this embodiment, the short-term energy source thus feeds the intermediate circuit directly, with no significant voltage conversion, which works very much in favor of security, speed and efficiency in the starting process.

In another preferred embodiment, the starter battery (or, with several starter batteries, one of the starter batteries) is not at the standard low voltage level (12V or 24V), but at the higher intermediate circuit level (e.g. 48V). Consequently, for simplicity in the following narrative, this starter battery will also be known as the "high tension (HT) battery". As various power-consuming devices on an automobile, in particular the lighting system, generally work better at lower voltages, there is a low voltage element in the vehicle's electrical system, set at a lower level than the intermediate circuit voltage. This low voltage element is fed, for example, via a potential divider across the starter battery into the intermediate circuit. The power electronics module for varying the discharge current is connected, for example, between the HT starter battery and the intermediate circuit. In other embodiments forms, the inverter between the intermediate circuit and the alternator is controlled such that the aforementioned discharge current from the intermediate circuit is no longer converted into alternating current. In this instance, the inverter is thus simultaneously the power electronics module for actively varying the discharge current. Returning now to FIG. 1, it illustrates the discharge current as a function of the battery temperature, the former being varied correspondingly by a power electronics module, as it is drawn from the starter battery during starting (explained in detail below). It is clear that this deals with an approximately linear function, thus having relatively low values at low temperatures, but rising with increasing temperature. The temperature values marked "$T_{min}$" and "$T_{max}$" are the limit values within which the battery may be operated (thus, for example, −30° C. to −80° C.).

Figure 2:
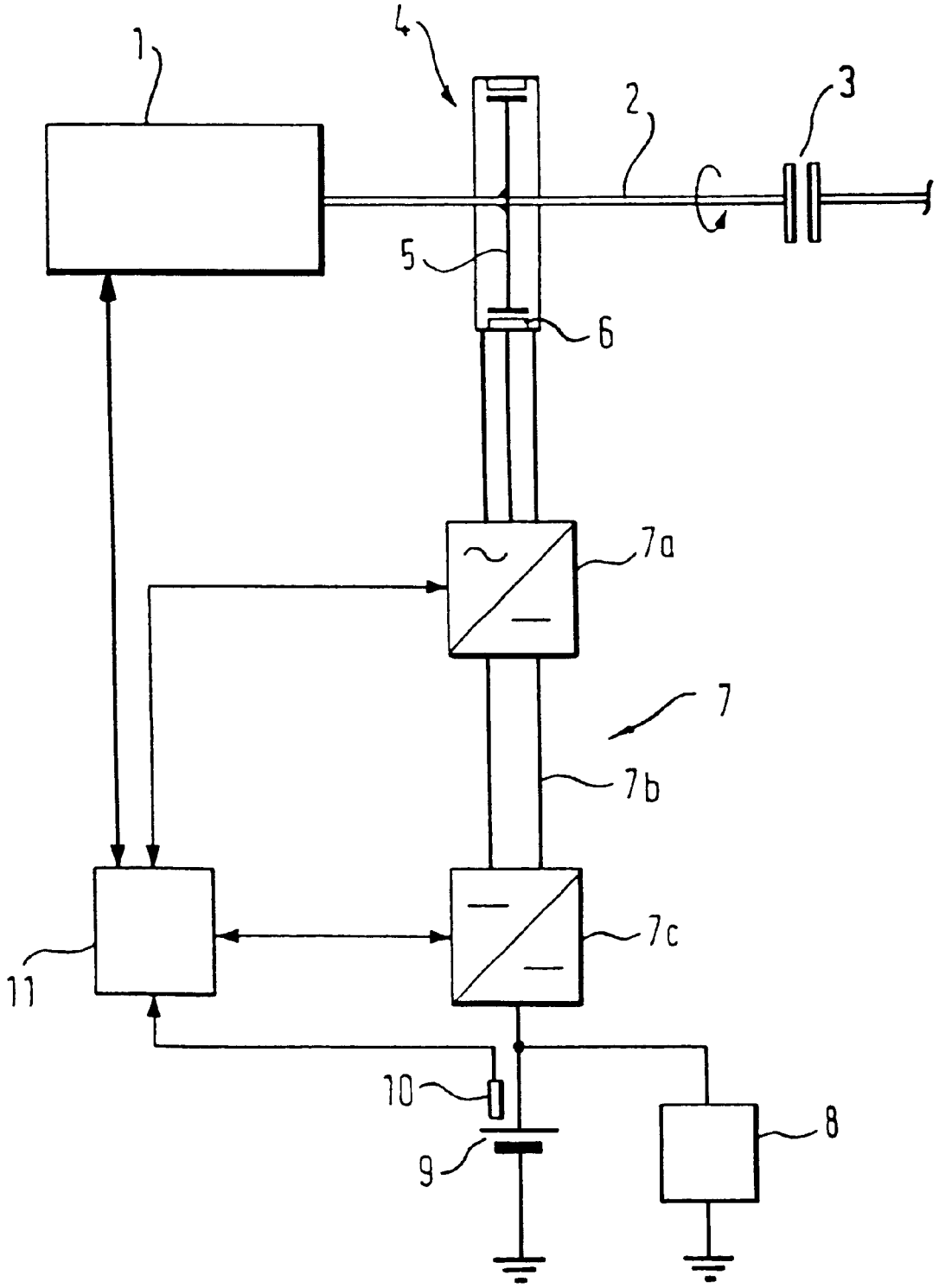
FIG. 2 shows a block diagram of the most significant modules in a first embodiment of a starter system.

The starter system specified in FIG. 2 is designed for an automobile, for example a passenger car. It has an internal combustion engine 1, transmitting torque to the driving wheels of the vehicle via a drive shaft 2 (e.g. the crankshaft of the internal combustion engine 1), a clutch 3 and other (not shown) components of a drive train. For the starting function the clutch 3 is shown in the disengaged position. An electrical motor 4 on the drive shaft 2 serves as the starter, in this case an asynchronous alternator. It has a fixed rotor 5 mounted co-axially with the drive shaft 2, and a rotor 6, mounted, for example, on the housing of the internal combustion engine 1. The starter 4 (and the devices described in detail below for feeding it and storing energy) are dimensioned such that the internal combustion engine 1 may preferably be started directly (i.e. without a flywheel function or similar operation). It is preferable for there to be no gearing up or down between the starter 4 and the internal combustion engine 1, so that the two may run permanently connected.

The (not shown) winding of the stator 6 is fed via a converter 7 with electrical currents and voltages that are practically freely variable in amplitude, phase and frequency. This relates, for example, to an intermediate circuit DC converter which, from an intermediate circuit supplying essentially constant DC, using, for example, electronic switching, generates sinusoidal width modulated pulses, which—normalized via the inductance of the electric motor 4—generate approximately sinusoidal currents of the desired amplitude, frequency and phase. The converter 7 is essentially built up from an inverter 7*a* (a DC-AC converter) adjoining the motor, an intermediate DC circuit 7*b*, and a up-converter 7*c* (a DC-DC converter) adjoining the vehicle electrical system. The up-converter 7*c* is coupled with a vehicle electrical system 8 and a starter battery 9. The vehicle electrical system 8 and the starter battery 9 are at a low voltage level, e.g. 12 or 24V. By comparison, the intermediate circuit 7*b* is at a higher voltage, preferably between 40 and 350V.

The up-converter 7*c* is used to increase the potential of the electrical energy drawn from the starter battery 9 during the start-up cycle from the low voltage level to the higher voltage level of the intermediate circuit 7*b*. It functions simultaneously as a current limiter which, in the absence of a control device, as explained below, prevents the stepped-up current (and thus the discharge current from the starter battery 9) exceeding a pre-defined value at any given time. When the internal combustion engine 1 is at rest, the starter battery also supplies the consumers connected to the vehicle electrical system as required. When the internal combustion engine 1 is running, the electric motor 4 is able to act as a generator for charging the starter battery 9 and supplying the vehicle electrical system 8. The up-converter 7*c* is therefore designed as a bi-directional converter, in order to be capable of supplying electrical energy from the starter battery 9 for the starting process (or its warm-up phase, FIG. 3) on one hand, and, on the other, to transfer energy from the intermediate circuit 7*b* to the low voltage side when the generator is running. In the latter case, it also works as a down-converter.

The inverter 7*a* converts DC from the intermediate circuit 7*b* to AC when the engine is running and, when the generator is running it feeds energy delivered by the electric motor 4 as DC, after rectification. An auxiliary capacitor (not shown) is placed in the intermediate circuit to supply pulsed voltages at a high pulse repetition frequency (preferably between 20 and 100 kHz), with the leading edge gradient required.

The starter battery 9, for example a conventional lead-acid accumulator, is fitted with a sensor 10 that measures the battery temperature at any given instant. The sensor has, for example, a sensing element made from electrically resistant material with a positive or negative temperature coefficient (PTC or NTC), in thermal contact with one or more of the electro-chemically active elements of the battery 9.

A control device 10 collects the temperature-related information supplied by the temperature sensor 10, calculates from this the maximum permissible discharge current, to avoid an excessive fall in the battery voltage, and feeds the up-converter 7*c* with the appropriate instructions, in order that the latter does not feed a larger current from the low voltage side into the intermediate circuit 7*b*. In addition, the control equipment 11 also controls the amount by which the up-converter 7*c* increases the voltage (and, correspondingly, the amount by which it decreases the voltage when the generator is running). This also controls the inverter 7*a*, at the same time regulating the amplitude, phase and frequency of the three-phase alternating current to be fed to the starter 4. For this purpose, it can receive information from an angular motion transmitter (not shown), from which it can calculate the instantaneous angular motion and speed of rotation of the drive shaft 2. Finally, the control equipment 11 is able to assume all the functions of a conventional internal combustion engine control system (in particular throttle valve control, fuel injection control, ignition control etc.).

Figure 3:
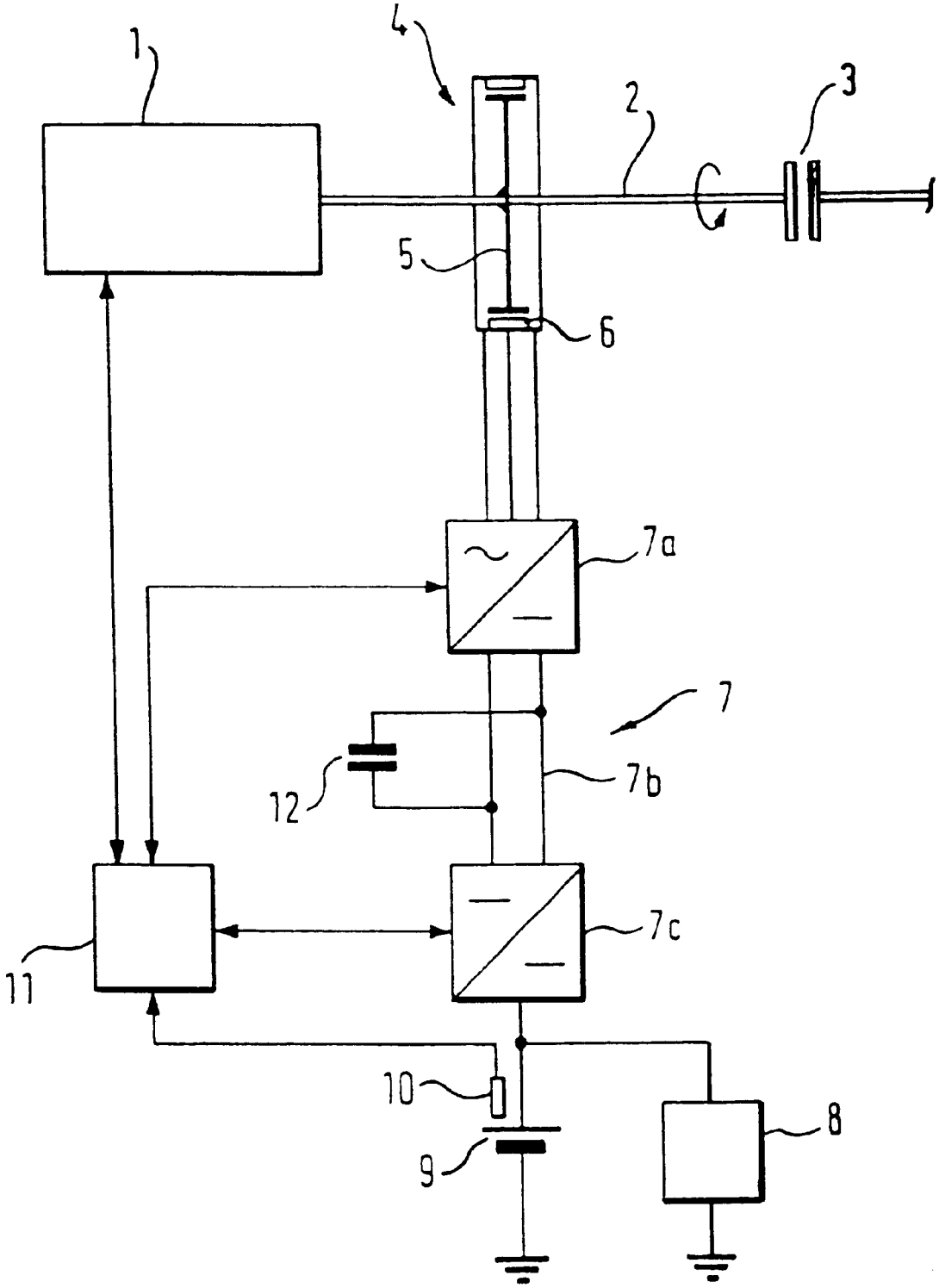
FIG. 3 shows a block diagram of a second embodiment, matching that in FIG. 2.

The embodiment specified in FIG. 3 is similar to that in FIG. 2 so, to avoid repetition, reference will be made to correspondences with the above embodiments. The immediately obvious difference is that, in FIG. 3, a short-term energy source 12, e.g. a storage capacitor, is provided in addition, which is—in the electrical sense—in the intermediate circuit 7*b*. In the embodiment shown, it is directly coupled electrically with the intermediate circuit but, in other embodiments (not shown), a current control device is connected between the short-term energy source 12 and the intermediate circuit 7*b*, allowing active variation of the current taken from or fed to the energy source 12.

A further difference from FIG. 2 is in the way the starting process is implemented. Naturally, the starter battery 9 initially charges up the short-term energy source 12 for the warm-up process. In connection with this, the up-converter 7*c* limits the discharge current drawn from the starter battery 9 in the way described above, dependent on the battery temperature (in the above-mentioned embodiment, with a current control device in circuit between the short-term energy source 12 and the intermediate circuit 7*b*, clearly the current control device can perform this function). The actual start is then carried out using the stored energy from the short-term energy source. In the preferred embodiments, the starter battery may also contribute energy to the starting process, where this contribution is limited through the effect of the up-converter 7*b* in the battery temperature-dependent way described above. It is taken as read that the control equipment 11 in FIG. 3 is designed and programmed such that it can control both the functions described for the charging of the short-term energy source 12 during the warm-up process and the additional functions claimed.

Figure 4:
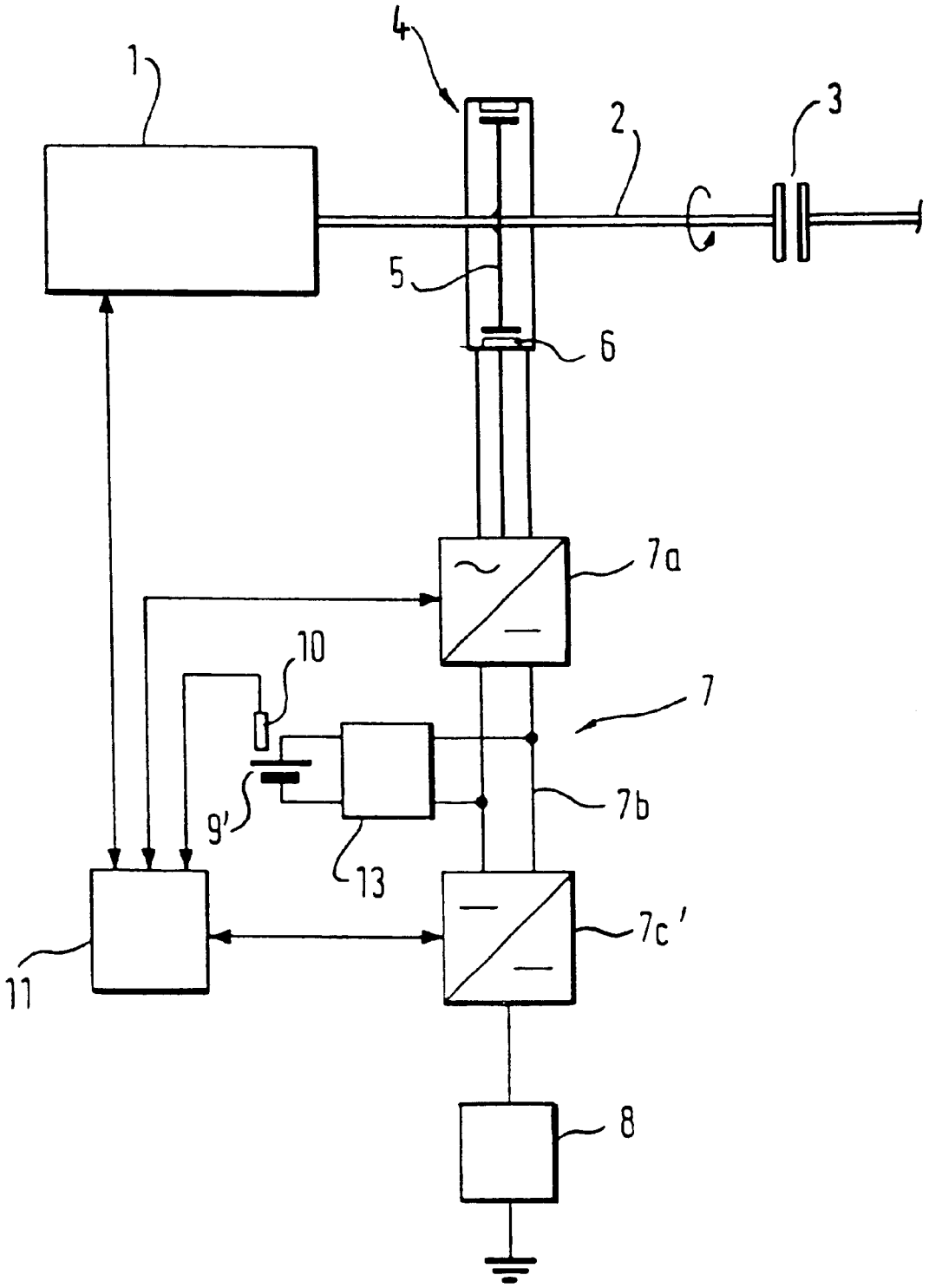
FIG. 4 shows a block diagram of a third embodiment, matching that in FIG. 2.

The starter system specified in FIG. 4 illustrates a further embodiment similar to that in FIG. 2. Again, to avoid repetition, reference will be made to correspondences with the above embodiments in FIG. 2. The immediately obvious difference from FIG. 2 is that the starter battery marked 9 in this figure is designed as a HT battery which, in potential terms, is at or near the increased voltage level of the intermediate circuit 7*b*. A current control device 13 is connected between the starter battery 9 and the intermediate circuit 7*b*, assuming the function of limiting the discharge current during the starting process, in the battery temperature-dependent way described above. The DC-DC converter marked 7*c* in this figure still has only the task of transferring energy from the intermediate circuit 7*b*, at a lower voltage, to the vehicle's low voltage electrical system 8. It thus functions purely as a down-converter. The starting process follows the sequence as in FIG. 2, with the difference that the starter battery 9 supplies current at the higher voltage level. Thus, the same performance is provided with the benefit of lower currents. Furthermore, the energy losses incurred reduce with the increase in voltage.

A further embodiment (not shown) corresponds to a combination of FIGS. 3 and 4. In this configuration, a short-term energy source 12 is connected in series with the intermediate circuit 7*b*, in addition to the starter battery 9 already connected. As described in FIG. 3, the short-term energy source 12 is charged up by the HT starter battery 9 during the warm-up phase, with the discharge current limited depending on the battery temperature.

Figure 5:
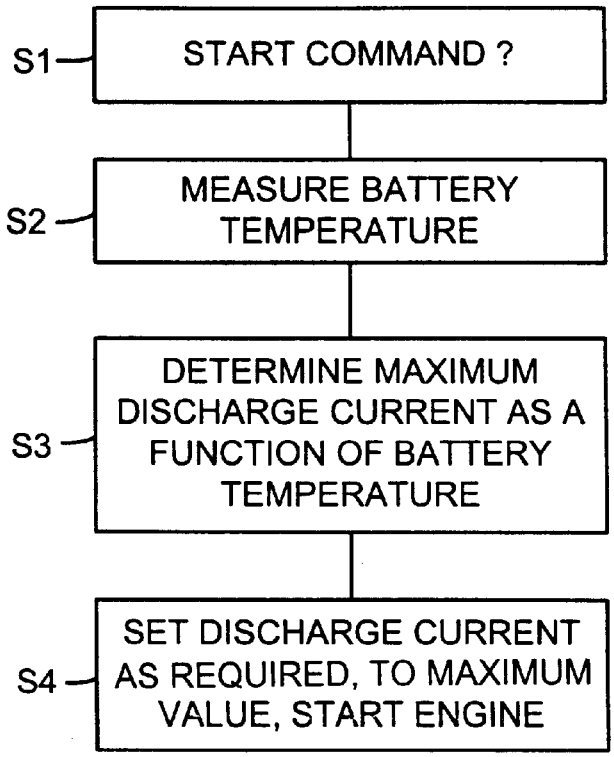
FIG. 5 shows a flow diagram for a starting procedure.

The flow diagram in FIG. 5 again illustrates the way in which the embodiments cited function. In the stage S1, a start command is expected. In embodiments with short-term energy stores, these may be charged up as a prophylactic measure before initiating the start command, in order to shorten the starting process to roughly the charging period for the short-term energy store. In stage S2, the battery temperature is measured, e.g. by reading the signals supplied by the battery temperature sensor 10 into the control equipment 11. In stage S3, the control equipment 11 determines the maximum discharge current as a function of battery temperature. In stage S4, the control equipment 11 notifies the up-converter 7*c* or the current control device 13 that no higher current than the maximum value determined in the previous stage should be permitted. On this notification, the start or charging up of the short-term energy source 12 takes place, during which the battery discharge current remains below the pre-stated limit. Clearly, the discharge current may remain below the limit value, even if no correspondingly higher current is required. This may be the case, for example, if the internal combustion engine is still warm or the short-term energy store is still partially charged.

Thus, a general purpose of the disclosed embodiments is to provide an improved starter system and method for starting an internal combustion engine.

All publications and existing systems mentioned in this specification are herein incorporated by reference.

Although certain systems, methods and products constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A starter system for an internal combustion engine, comprising:

an electric starter;

a starter battery;

a temperature measuring device for measuring a temperature of the starter battery;

a power electronics module, which actively varies a magnitude of a discharge current drawn from the starter battery; and a control device, feeding the power electronics module with a value of the discharge current to be varied, where, at low battery temperatures, a maximum discharge current is lower than at high temperatures.

2. The starter system of claim 1, wherein the starter is fed at a higher voltage than that of the starter battery, and the power electronics module for active variation of the discharge current also performs the function of an voltage up-converter.

3. The starter system of claim 2, wherein the energy required from the starter battery during the starting process is discharged via the voltage up-converter.

4. The starter system of claim 1, wherein the starter is an alternator whose supply voltage is derived from inversion of a direct current from an intermediate circuit.

5. The starter system of claim 4, wherein the DC provided by the intermediate circuit is higher than a starter battery voltage, and a voltage up-converter is connected in series between the starter battery and the intermediate circuit.

6. The starter system of claim 4, wherein a low voltage component of a vehicle electrical system is provided, and the intermediate circuit voltage is higher than the voltage of the low level component, the starter battery is at the higher intermediate circuit voltage level, and the power electronics module varies the magnitude of the current fed from the starter battery to the intermediate circuit during starting.

7. The starter system of claim 1, further comprising a short-term energy source, delivering all or part of the starting energy to the starter during the starting process, the charging of the short-term energy source being effected as a warming-up process by means of a discharge current from the starter battery, and the power electronics module is connected in series between the starter battery and the short-term energy source.

8. The starter system of claim 7, wherein the short-term energy source is charged to a higher potential than the starter battery.

9. The starter system according to claim 8, wherein the short-term energy source is at or near an increased voltage level of an intermediate circuit.

10. The starter system of claim 1, wherein the starter battery is for at least one of (a) preparing to start the engine, (b) preparing to start the engine by charging a short term storage device, and (c) starting the engine.

11. The starter system of claim 1, wherein the discharge current drawn from the starter battery charges a short term storage device to prepare to start the engine.

12. A method for starting an internal combustion engine with an electric starter, a starter battery and a device for measuring a temperature of the starter battery, comprising:

measuring the starter battery temperature;

determining a maximum discharge current as a function of the measured battery temperature; and actively limiting a discharge current drawn by the electric starter to a calculated maximum value.

13. The method of claim 12, wherein the starter is fed at a higher voltage than that of the starter battery,-and a power electronics module for active variation of the discharge current also performs the function of an voltage up-converter.

14. The method of claim 13, wherein the energy required from the starter battery during the starting process is discharged via the voltage up-converter.

15. The method of claim 12, wherein an alternator is used as the starter, and the starter's supply voltage is derived from inversion of a direct current from an intermediate circuit.

16. The method of claim 15, wherein the DC provided by the intermediate circuit is higher than the starter battery voltage, and a voltage up-converter is connected in series between the starter battery and the intermediate circuit.

17. The method of claim 15, wherein a low voltage component of a vehicle electrical system is provided, and the intermediate circuit voltage is higher than the voltage of the low level component, the starter battery is at the higher intermediate circuit voltage level, and the power electronics module varies the magnitude of the current fed from the starter battery to the intermediate circuit during starting.

18. The method of claim 12, wherein a short-term energy source delivers all or part of the starting energy to the starter during the starting process, the charging of the short-term energy source being effected as a warming-up process by means of a discharge current from the starter battery, and the power electronics module is connected in series between the starter battery and the short-term energy source.

19. The method of claim 18, wherein the short-term energy source is charged to a higher potential than the starter battery.

20. The method according to claim 19, wherein the short-term energy source is at or near an increased voltage level of an intermediate circuit.

21. The method of claim 12, further comprising charging a short term storage device with the current drawn from the starter battery to prepare to start the engine.

* * * * *